US006464510B1

(12) United States Patent
Len

(10) Patent No.: US 6,464,510 B1
(45) Date of Patent: Oct. 15, 2002

(54) MICROWAVE CIRCUIT CONNECTOR

(75) Inventor: Michael J. Len, Skaneateles, NY (US)

(73) Assignee: Anaren Microwave, Inc., Syracuse, NY (US)

( * ) Notice: Subject to any disclaimer, the term of this patent is extended or adjusted under 35 U.S.C. 154(b) by 0 days.

(21) Appl. No.: 09/317,507

(22) Filed: May 24, 1999

(51) Int. Cl.[7] ..... H01R 12/00
(52) U.S. Cl. ..... 439/65
(58) Field of Search ..... 439/65, 66, 81, 439/507, 511, 512, 513

(56) References Cited

U.S. PATENT DOCUMENTS

| | | | | |
|---|---|---|---|---|
| 3,270,311 A | | 8/1966 | Deer et al. | 439/65 |
| 3,591,834 A | * | 7/1971 | Kolias | 439/65 |
| 4,358,173 A | * | 11/1982 | Conrad | 439/71 |
| 5,062,809 A | | 11/1991 | Sakamoto et al. | 439/581 |

* cited by examiner

*Primary Examiner*—Tulsidas Patel
(74) *Attorney, Agent, or Firm*—Bond, Schoeneck & King, LLP

(57) ABSTRACT

A method and apparatus for making a connection to or between one or more modules in a microwave communication system includes a first module having a plurality of contact pads mounted on a surface adjacent one edge of the module; optionally a second module having a plurality of contact pads mounted on a surface adjacent a confronting edge of the second module; a contact assembly including a housing and a plurality of resilient contacts disposed within the housing, each contact having at least a first and optionally a second contact surface aligned with and connected to the contact pads on the first and second modules respectively; and a plurality of screws or the like for anchoring the housing to the first and optionally the second module and bridging the gap between them, the housing arranged to deform the plurality of contacts to urge them into resilient engagement with the contact pads on the modules.

16 Claims, 5 Drawing Sheets

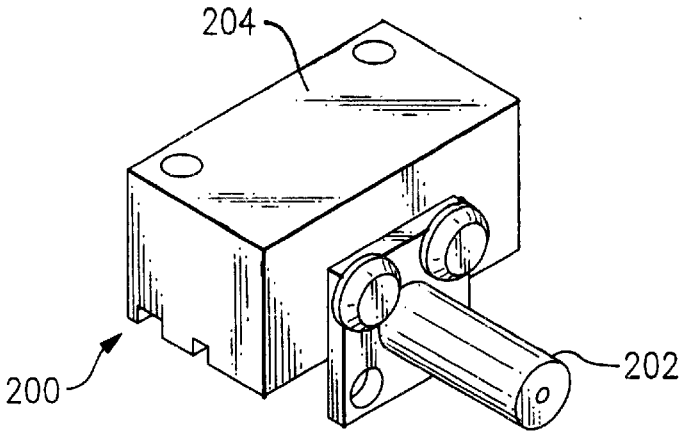
FIG.19
FIG.20
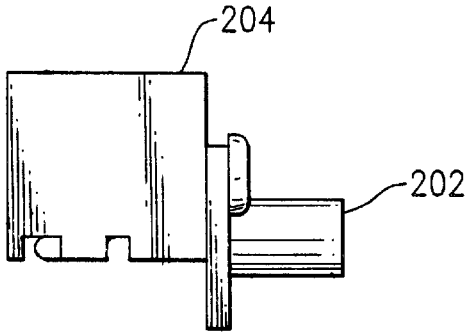
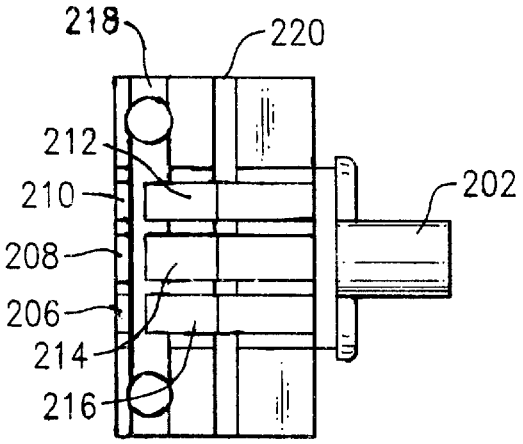
FIG.21

MICROWAVE CIRCUIT CONNECTOR

BACKGROUND OF THE INVENTION

This invention relates generally to microwave circuits and more particularly to a connector for making connectors to microwave modules, and for electrically connecting microwave modules in systems that employ a plurality of replaceable modules, one or more of which may need to be removed for servicing from time to time.

Microwave communication systems increasingly rely on a plurality of modular components such as power amplifiers, power splitters and combiners, directional compasses, transformers and the like, that are combined to form communications apparatus such as transmitters, receivers, and the like and systems such as base stations. By employing a modular approach, the cost of individual components can be reduced, the serviceability of the systems can be increased, and in some cases the reliability and performance of the overall system can be enhanced.

One area in which modular components are increasingly employed is in microwave transmitters. Where a relatively high power transmitter is needed, it is advantageous to employ a plurality of lower power modules together with power splitters and power combiners for dividing the input signal to the inputs of the plurality of amplifiers and recombining the outputs of the amplifiers for connection to an antenna or the like. Individual low to medium power modules, 10 to 100 watts, for example, can be combined to create a higher power amplifier (500–1000 watts) at a much lower cost than providing a single high power amplifier.

In addition, if one of a multiplicity of modules forming high power amplifier fails, the amplifier can continue to function, be it at a low power level, and service is not necessarily interrupted while the defective module is identified and replaced.

Performing reliable high quality connections to microwave modules and among the components of microwave communications systems is essential to their effective operation. Heretofore, a number of approaches have been employed, including co-axial cables having discrete connectors attached to the inputs and outputs of the amplifier modules, the splitter combiners, the antenna, and the like. While high quality co-axial connectors are available, they are expensive to purchase, and difficult to attach to amplifiers and other microwave components, often requiring skilled technicians to attach the connectors to the modules.

An alternative to discrete connectors is the use of solder connections. A low impedance strap is physically soldered to a contact on each of two modules to be connected. The strap spans the gap between the modules and can form a high quality connection, even at very high frequencies.

Although soldered connections are generally much less expensive than discrete RF connectors, they still require skilled labor to attach and are not easy to remove and replace if a faulty module must be repaired.

It is an object of this invention to provide a method and apparatus for making connections to and between components of a high frequency communication system that addresses the problems of the prior art just discussed.

It is another object of this invention to provide apparatus for connecting modules in a high frequency communication system that is less expensive than discrete connectors.

It is another object of this invention to provide a method and apparatus for connecting modules and a high frequency communication system that is easier to implement than soldered connections.

It is yet another object of this invention to provide a method and apparatus for making connections to modules and for connecting modules to each other in a high frequency communication system that can be attached without the need for difficult assembly techniques, or requiring highly skilled assemblers; but which can be readily removed and replaced to allow the modules of the communication system to be serviced as required.

Briefly stated, and according to one aspect of the invention, a method and apparatus for making a connection to or between one or more modules in a microwave communication system includes a first module having a plurality of contact pads mounted on a surface adjacent one edge of the module; optionally a second module having a plurality of contact pads mounted on a surface adjacent a confronting edge of the second module; a contact assembly including a housing and a plurality of resilient contacts disposed within the housing, each contact having at least a first and optionally a second contact surface aligned with and connected to the contact pads on the first and second modules respectively; and a plurality of screws or the like for anchoring the housing to the first and optionally the second module and bridging the gap between them, the housing arranged to deform the plurality of contacts to urge them into resilient engagement with the contact pads on the modules.

In accordance with another aspect of the invention, the resilient contacts are formed from a beryllium copper alloy, or any other suitable conductive resilient material.

In accordance with another aspect of the invention, the resilient contacts have a generally W shape, with spaced apart five contact surfaces connected by an inverted V shaped connective portion, and having slightly upwardly extended attaching portions at the extremities of the resilient contact.

In accordance with another aspect of the invention, a connector for making a connection to a microwave circuit module having a plurality of contact pads found on a surface adjacent one edge of the module comprises a contact assembly including a housing and a plurality of resilient contacts disposed within the housing, each contact having a contact surface aligned with and adapted to be connected to the contact pads on the module, an RF connector attached to the housing, and an electrical connection between the resilient contacts and the RF connector.

The novel aspects of the invention are set forth with particularity in the appended claims. The invention itself, together with further objects and advantages thereof may be more readily comprehended by reference to the following detailed description of a presently preferred embodiment of the invention, taken in conjunction with the accompanying drawing, in which:

FIG. 19 is a perspective view of the body of a connector in accordance with this invention having an RF connector attached thereto;

FIG. 20 is a side elevation thereof; and

FIG. 21 is a bottom plan view thereof.

Figure 1:
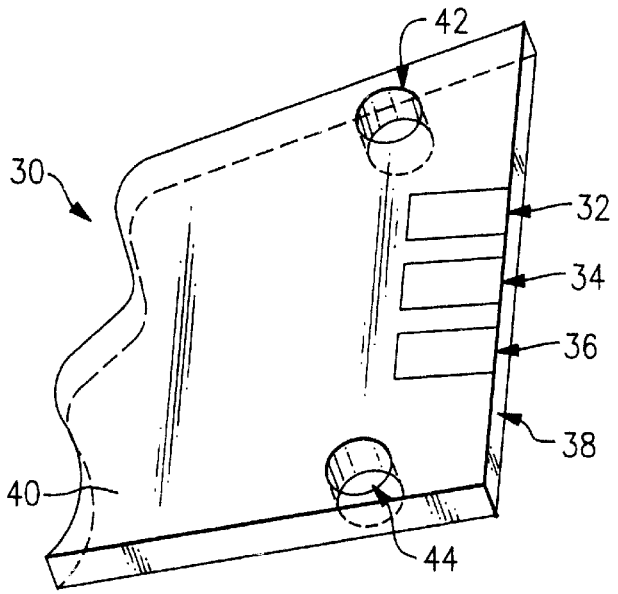
FIG. 1 is a perspective view of a portion of an electronic component showing an arrangement of contact pads suitable for use with the connector of this invention.

DETAILED DESCRIPTION OF THE PREFERRED EMBODIMENT:

Referring now to FIG. 1, a fractional, cut-away portion of a microwave circuit module 30 of the type in connection with which the connector of this invention can be used is shown in a perspective view. The module 30 is greatly simplified in FIG. 1, only the spaced apart contact pads 32, 34, 36 of the microwave module 30 that are intended to be connected to a second microwave module disposed adjacent to the edge 38 of the module 30 at which the pads were formed are shown. It will be understood that modules of the type to which the invention is addressed are typically multi layer devices having a plurality of spaced conductive layers separated by dielectric layers, and include active and/or passive components such as strip line segments, capacitors, resistors, transistors, and the like, which may be formed either within the layers of the module, or attached to other components of the modules at surfaces using surface mount techniques or other techniques. Modules of the type to which the invention is addressed may employ any or all fabrication techniques known for use in such modules.

The spaced apart contact pads 32, 34, 36 shown in FIG. 1 include a first ground pad 32, a second active conductor pad 34, and a third ground pad 36. The pads are selected to have a dimension and spacing to produce a characteristic impedance selected in accordance with the other elements of the microwave module, so as to prevent the inadvertent formation of impedance discontinuities that may adversely affect the operation of the module. It will be understood by those skilled in the art that the pads 32, 34, 36 may differ in shape from those shown in FIG. 1 without departing from the scope of the invention. The surface 40 of the module 30 also includes first and second openings 42, 44 for receiving screws or other fasteners to hold the connector in place, as will be shown in more detail later.

Figure 2:
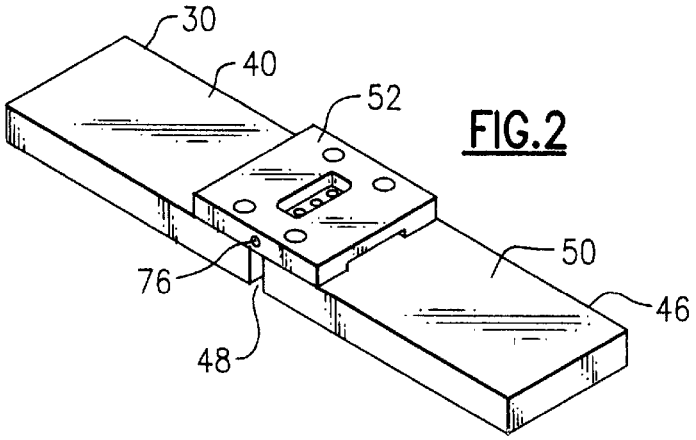
FIG. 2 is a simplified perspective view of two modules of a communications system, showing a contact assembly in accordance with the invention forming a connection between the two modules.

Referring now to FIG. 2, a first microwave module 30 and a second microwave module 46 are shown in confronting spaced apart relationship separated by a gap 48. Although not visible in FIG. 2, each of the microwave modules 30, 46 includes contacts of the type shown in FIG. 1, disposed along the surfaces 40, 50 adjacent the confronting edged of the modules. The modules 30, 46 shown in FIG. 2 are illustrated as if only one set of connections is present on each module. It will be understood that in practice modules of the type shown in FIG. 2 may have a multiplicity of connections. For example, one particularly advantageous application for the connector of this invention is in connecting a multiplicity of power amplifier modules to a power splitter, and to a power combiner in a microwave amplifier system. In such an application, a power splitter has a plurality of sets of contacts arranged along one edge. A plurality of separate microwave amplifier modules is arranged adjacent to the one edge, and spaced apart therefrom, with input connectors aligned with output connectors on the power divider module. A power combiner module also having a plurality of sets of input contacts is arranged adjacent opposite ends of the power amplifier modules, and a plurality of connectors in accordance with the invention is employed to connect each of the amplifier modules to a corresponding set of contact pads on the combiner module.

Referring back to FIG. 2, a connector 52 in accordance with this invention is shown fixed in position, and connecting the power modules 30, 46 shown in FIG. 2. The connector preferably includes a connector body 54 formed from a dielectric material, selected so as introduce minimal losses at the frequency at which the microwave modules in connection with which the connector is employed operate. In accordance with the invention, the body of the connector may be made from plastic, Teflon, polyurethane or the like. Preferably the body is molded, but it may be machined from suitable materials if desired.

The body of the connector is provided with four openings 56, 58, 60, 62 for receiving fasteners that pass through the body of the connector into the corresponding openings 42, 44 in the microwave modules 30, 46, as shown in FIG. 1. A variety of types of fasteners may be employed in connection with the invention, such as but not limited to self tapping screws, machine screws or the like. It is preferred in accordance with the invention that the fasteners be readily removable and replaceable to allow the connector to be removed from the module, so that the modules can be serviced or replaced easily.

The fasteners may be made from non-ferrous material such as high strength plastic or the like, to avoid any undesirable interactions with the microwave circuits.

Figure 5:
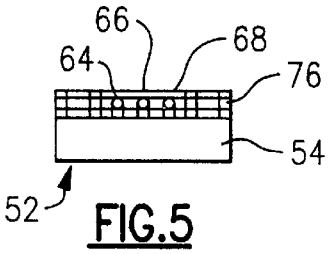
FIG. 5 is a section taken along line 5–5 of FIG. 3.
Figure 3:
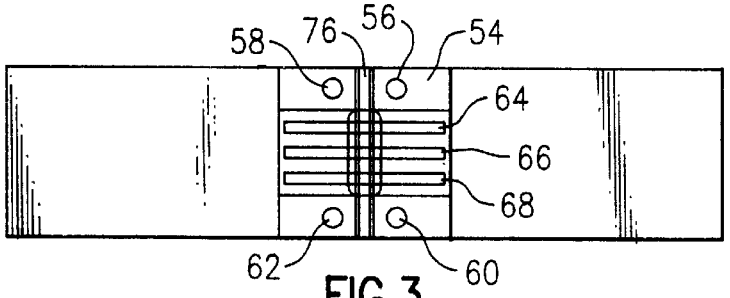
FIG. 3 is a top plan view of the modules and connector of FIG. 2.
Figure 4:
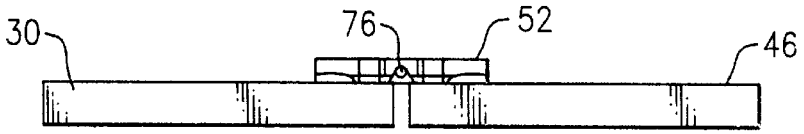
FIG. 4 is a side elevation thereof.
Figure 7:
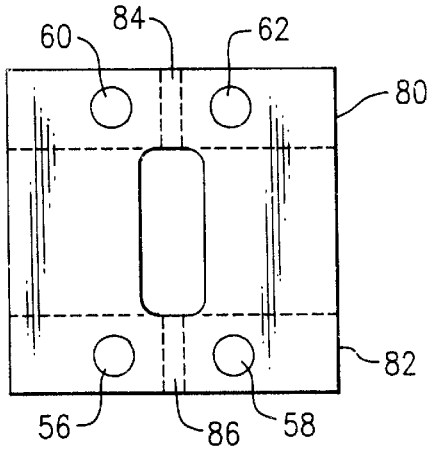
FIG. 7 is a top plan view thereof.
Figure 6:
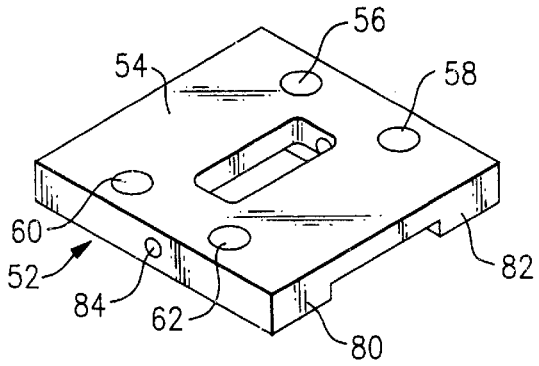
FIG. 6 is a perspective view of the body of a connector in accordance with this invention.
Figure 8:
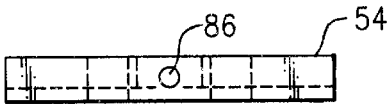
FIG. 8 is a left side elevation thereof.
Figure 9:
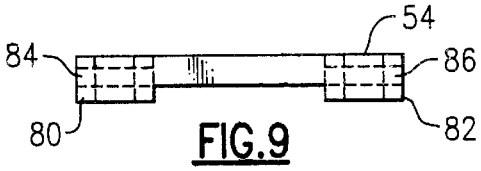
FIG. 9 is a front elevation thereof.

Additional views of the connector 52 are shown in FIGS. 3, 4 and 5, which are a top plan view, a side elevation, and an end elevation respectively. As can be seen easily in FIGS. 3 and 4, the connector 52 includes three conductive resilient contacts 64, 66, 68 carried by the connector body 54, arranged parallel to one another and spanning the gap between the two microwave modules. The resilient contacts are generally W shaped, having a central inverted V shaped portion 70 and two downwardly facing contact surfaces 72, 74. The contacts themselves are shown in more detail in enlarged form in FIGS. 10 and 11. The contacts are formed from a resilient material, such as beryllium copper or, where beryllium is not permitted, other resilient material. Preferably, the resilient contacts are coated with a highly conductive material, such as white bronze, sometimes sold under the trademark Sucoplate® by Huber & Suhmer Inc. of Essex, Vermont, to reduce, to the extent possible, the resistance between the contacts and the contact pads of the microwave modules.

In accordance with one embodiment of the invention, a nonconductive pin 76 extends transversely with respect to the contacts 64, 66, 68 through journals in the connector housing 54, to retain the resilient contacts in the housing. The pin engages the base of the inverted V shaped center portion 70 of the resilient contacts 64, 66, 68.

The body 54 of the connector 52 is shown in more detail in FIGS. 6–9. The connector body 54 is generally rectangular and has first and second downwardly depending mounting pads or legs 80, 82. First and second transverse cylindrical openings 84, 86 extend through the body of the connector for receiving the pin 76 for retaining the resilient contacts in place. Four mounting holes 62, 64, 66, 68 are provided extending through the body 54 and the legs 80, 82 for receiving fasteners to attach the connector to the microwave modules.

Figure 10:
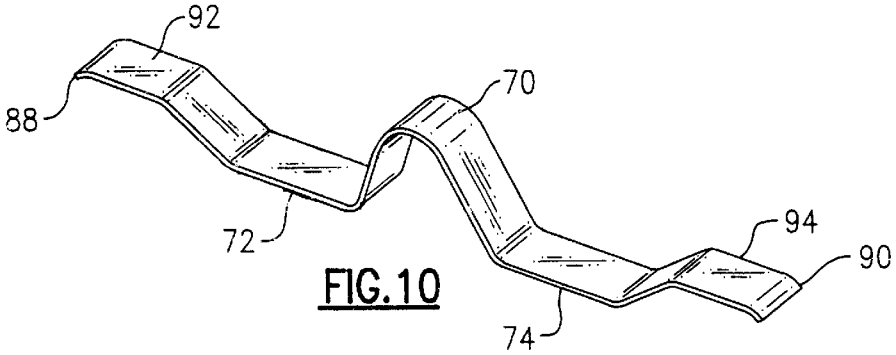
FIG. 10 is a perspective view of a spring contact in accordance with this invention.
Figure 11:
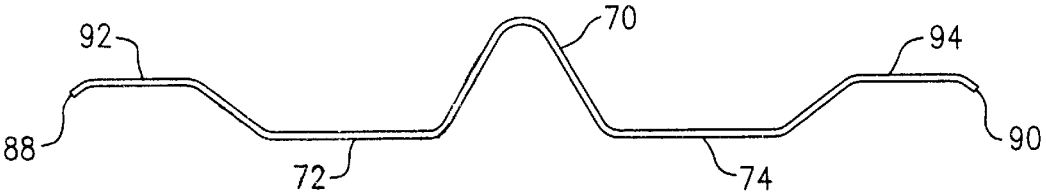
FIG. 11 is a side elevation thereof.

With reference to FIGS. 10 and 11, the manner in which the resilient contact strips 64, 66, 68 are retained in the connector body will be appreciated. The ends 88, 90 of the contact strips are provided with upwardly facing contact surfaces 92, 94 for engaging the under surface of the connector body. The ends of these portions are turned down slightly to enable the contact surfaces 92, 94 to slide easily with respect to the connector body.

Figure 12:
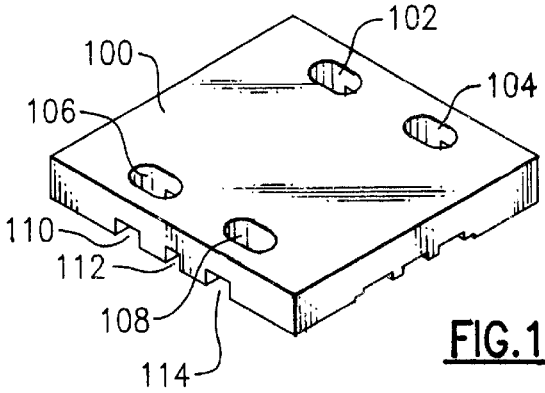
FIG. 12 is a perspective view of the body of a connector in accordance with another aspect of the invention.
Figure 13:
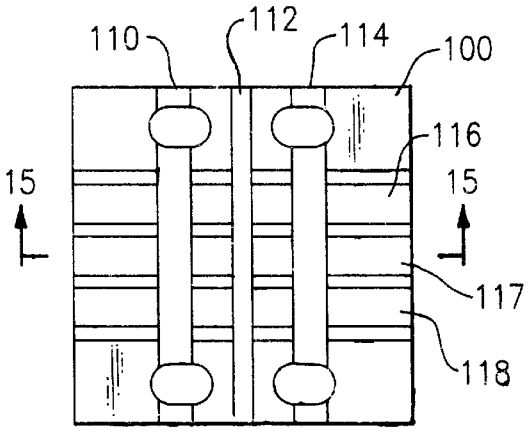
FIG. 13 is a bottom plan view thereof.

An alternative embodiment of the invention is shown in FIGS. 12–15. FIG. 12 shows a top perspective view of a connector body 100 in accordance with the invention. The body includes a plurality of preferably elongated mounting holes 102, 104, 106, 108 easily visible in FIG. 12, and a plurality of slots 110, 112, 114 for receiving resilient contacts. As can be seen in FIG. 13, grooves 116, 117, 118 are arranged orthogonally with respect to the slots for receiving the center portions of the resilient contacts, as will be seen more clearly in the other figures.

Figure 14:
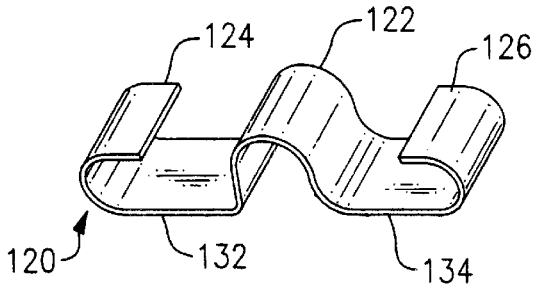
FIG. 14 is a perspective view of a spring contact in accordance with the invention.
Figure 15:
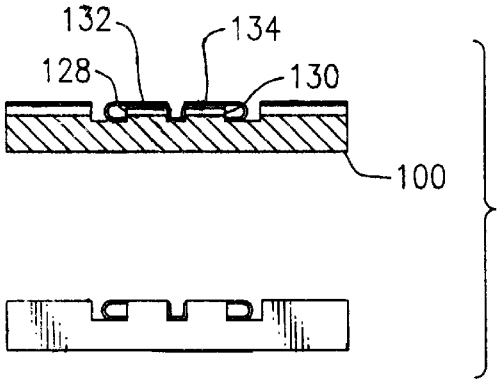
FIG. 15 is a section view taken along line 15–15 of FIG. 13.

A resilient contact 120 adapted to be used in a connector body is illustrated at FIG. 14. The resilient contact is generally W-shaped, but includes a short curved central portion 122 adapted to be received in the center slot 117 of the connector body 100, and two inwardly turned end portions 124, 126 adapted to engage the vertical walls 128, 130 of the connector body (see FIG. 15) to retain the contact in place. The contact includes flat surface portions 132, 134 that are adapted for form a low resistance connection with the contact pads on the modules.

Figure 16:
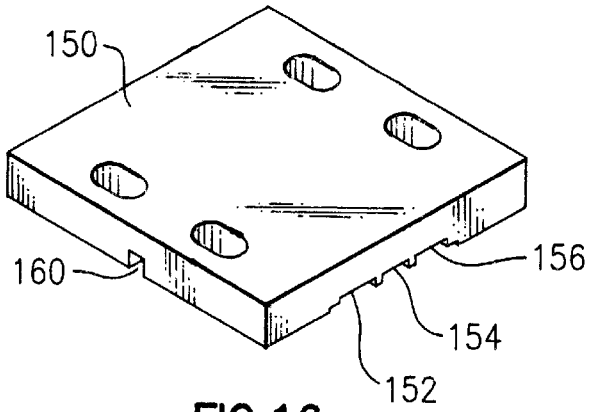
FIG. 16 is a perspective view of the body of a connector in accordance with another embodiment of the invention.
Figure 17:
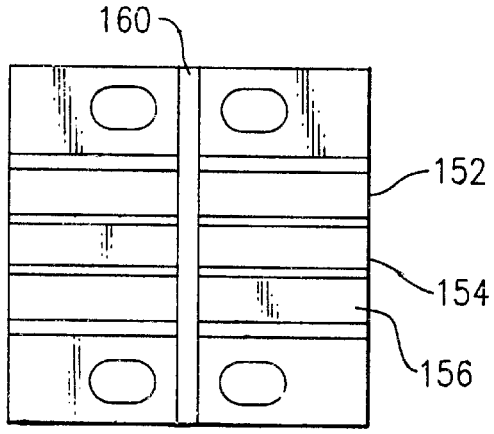
FIG. 17 is a bottom plan view thereof.
Figure 18:
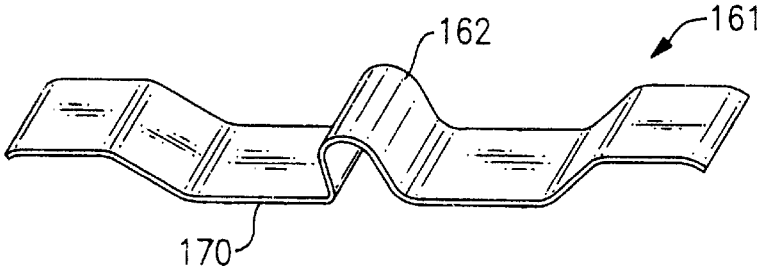
FIG. 18 is a perspective view of a spring contact for use in connection with the embodiment of the invention shown in FIGS. 16 and 17.

Another embodiment of the invention is shown in FIGS. 16 through 18. In accordance with this embodiment, a molded connector body 150 is formed as shown in FIG. 16. The body has three grooves 152, 154, 156 for receiving parallel resilient contacts 161, such as the one shown in FIG. 18, and a transverse slot 160 for receiving the rounded upstanding center portion 162 of the resilient contact 161 in a compressed relationship sufficient to hold the contact 161 in place in the connector body 150. The width of the slot 160 is preferably made slightly less than the uncompressed width of the center portion 162 of the contact 161, so that the contact can be pressed into place.

The resilient contact has downwardly facing contact surfaces 170, 172 that engage the conductive surfaces of the module in a manner already discussed.

In accordance with another aspect of the invention, as shown in FIGS. 19–21, a connector 200 in accordance with this invention includes a standard coaxial cable connector 202 to form a convenient structure for making an attachment to a single microwave module. A connector body 204 includes three grooves 206, 208, 210 and three half contacts 212, 214, 216, one disposed in each groove. The half contacts are almost literally one half of the contact shown in FIG. 14. A pair of transverse slots 218, 220 extends across the grooves to hold one end of each contact.

Electrical connections are made between the half contacts 212, 214, 216 and the coaxial connector 202. Preferably, each of the half contacts includes an extension that is electrically connected to the co-axial connector. Contacts 210 and 206 are connected to the shell of the co-axial connector and center contact 208 is connected to the center pin of the connector. While it is preferable to provide resilient contacts that extent into close proximity with the connector and may be directly attached thereto, connection may also be made by conventional wiring techniques.

While the invention has been described in connection with several presently preferred embodiments thereof, those skilled in the art will recognize that many modifications and changes may be made therein without departing from the true spirit and scope of the invention, which accordingly is intended to be defined solely by the appended claims.

What is claimed is:

1. A connector for connecting to microwave modules having a plurality of spaced apart contact pads on a surface adjacent to an edge of the module, to a plurality of spaced apart pads on a surface adjacent to an edge of a second module, comprising:

a connector body, a plurality of resilient contacts carried by said body, each resilient contact presenting a pair of generally coplanar contact surfaces, said contact surfaces of each resilient contact aligned with corresponding contact pads of the first and second modules; and said resilient contact is removable and secured to said connector body by a removable pin.

2. The connector of claim 1 in which the connector body is generally rectangular, and the plurality of resilient contacts comprises a plurality of elongated contacts arranged parallel to each other in the connector body.

3. The connector of claim 1 in which at least one of the resilient contacts comprises an inverted V-shaped portion between the coplanar contact surfaces.

4. The connector of claim 3 in which at least one of the of resilient contacts each comprises end portions engaging the connector body, for retaining the contact in the connector body.

5. The connector of claim 3 comprising a retainer engaging the V-shaped portion.

6. The connector of claim 1 comprising a fastener disposed in the opening for attaching the connector body to first module.

7. The connector of claim 1 comprising a conductive coating on the contact surfaces.

8. The connector of claim 1 comprising a fastener disposed in the opening for attaching the connector body to second module.

9. A connector for making a connection to a first microwave module having a plurality of spaced apart contact pads on a surface adjacent to an edge of the first module, to a second microwave module having a plurality of spaced apart pads on a surface adjacent to an edge of the second module, comprising:

a connector body;

a plurality of resilient contacts carried by said body, each resilient contact presenting a pair of generally coplanar contact surfaces, said contact surfaces of each resilient contact aligned with corresponding contact pads of the first and second modules; and said resilient contact is removable and secured to said connector body by a removable pin.

10. The connector of claim 9 in which the connector body is generally rectangular, and the plurality of resilient contacts comprises a plurality of elongated contacts arranged parallel to each other in the connector body.

11. The connector of claim 9 in which at least one of the resilient contacts comprises an inverted V-shaped portion between the coplanar contact surfaces.

12. The connector of claim 11 in which at least one of the of resilient contacts each comprises end portions engaging the connector body, for retaining the contact in the connector body.

13. The connector of claim 11 comprising a retainer engaging the V-shaped portion.

14. The connector of claim 13 in which the retainer comprises a transverse pin mounted to the connector body.

15. The connector of claim 9 comprising a conductive coating on the contact surfaces.

16. The connector of claim 11 in which the connector body comprises a groove and the inverted V-shaped portion between the coplanar contact surfaces is disposed in the groove.

* * * * *